US005885382A

United States Patent [19]

Sakurai et al.

[11] Patent Number: 5,885,382

[45] Date of Patent: Mar. 23, 1999

[54] PRIMARY COOLING METHOD IN CONTINUOUSLY ANNEALING STEEL STRIP

[75] Inventors: Koichi Sakurai; Tatsuru Shibuya; Hisamoto Wakabayashi; Kouichi Waki; Seiji Sugiyama, all of Kitakyushu; Kazunori Nagai, Futtsu, all of Japan

[73] Assignee: Nippon Steel Corporation, Tokyo, Japan

[21] Appl. No.: 875,839

[22] PCT Filed: Aug. 26, 1996

[86] PCT No.: PCT/JP96/02387

§ 371 Date: Aug. 6, 1997

§ 102(e) Date: Aug. 6, 1997

[87] PCT Pub. No.: WO97/24468

PCT Pub. Date: Jul. 10, 1997

[30] Foreign Application Priority Data

Dec. 26, 1995 [JP] Japan ..... 7-351912

[51] Int. Cl.[6] ..... C21D 9/52; C21D 6/02

[52] U.S. Cl. ..... 148/661; 148/662; 148/623

[58] Field of Search ..... 148/654, 334, 148/661, 662, 623

[56] References Cited

U.S. PATENT DOCUMENTS

| | | |
|---|---|---|
| 3,068,586 | 12/1962 | Vaughan et al. . |
| 4,704,167 | 11/1987 | Kozaburo et al. . |
| 5,137,586 | 8/1992 | Klink . |

FOREIGN PATENT DOCUMENTS

| | | |
|---|---|---|
| 031 012 | 7/1981 | European Pat. Off. . |
| 182 050 | 5/1986 | European Pat. Off. . |
| 4208485 | 2/1993 | Germany . |
| 333 116 | 10/1973 | United Kingdom . |

*Primary Examiner*—Deborah Yee
*Attorney, Agent, or Firm*—Kenyon & Kenyon

[57] ABSTRACT

In a method of continuously annealing steel strip comprising a heating step (A), a soaking step (B), a primary cooling step (C) including a rapid cooling step at least in a second half thereof, an overaging step (D), and a final cooling step (E), inert atmosphere gas containing $H_2$ gas in the concentration of 30–60% is employed as cooling gas for use in the rapid cooling step, the blowoff temperature of the cooling gas is 30°–150° C., and the blowoff speed of the cooling gas is 100–150 m/sec. The primary cooling method in continuously annealing steel strip provides the primary cooling step (C) including the rapid cooling step which can be carried out with a high efficiency and a low cost.

8 Claims, 7 Drawing Sheets

PRIMARY COOLING METHOD IN CONTINUOUSLY ANNEALING STEEL STRIP

TECHNICAL FIELD

The present invention relates to a primary cooling method in continuously annealing steel strip, and more particularly to a rapid cooling in the primary cooling step by blowing inert atmosphere gas that contains $H_2$ gas as cooling gas.

BACKGROUND ART

Because of being too hard and thereby exhibiting almost no workability, a steel strip after cold rolling cannot be subjected to press forming and hence cannot be put into practical use so long as no further treatment is effected. To improve the workability of the steel strip, it is necessary to increase the grain size of the steel strip sufficiently, and to reduce the amount of solid-solution state carbon contained in the steel strip as small as possible.

To this end, continuous annealing treatment including soaking, primary cooling and averaging is performed. More specifically, a steel strip after cold rolling is heated above the recrystallization temperature and is kept at the soaking temperature of 700°–850° C. for a certain period of time for growth of crystal grains. During the soaking step, the dissolved carbon is generated in solid-solution state, and it must be settled to be harmless in the succeeding steps. Therefore, in the first half of the primary cooling, the steel strip is slowly cooled down to a certain temperature (600°–700° C.) so as to increase the amount of solid-solution state carbon in the ferrite matrix, and to prevent deterioration of flatness of the steel strip such as cooling buckle for achieving satisfactory operation. In the second half of the primary cooling, the steel strip is rapidly cooled down to the overaging temperature (about 400° C.). Then the steel strip is kept at the overaging temperature for a certain period of time so that the solid-solution state carbon is precipitated as cementite for reducing the amount thereof. Lastly the steel strip is subjected to the final cooling.

Where cooling by water-gas mixture is performed in the second half of the primary cooling to rapidly cool the steel strip, an oxide film is formed on the surface of the steel strip so that a post-treatment such as acid pickling is required immediately after the continuous annealing. In view of the above, a method of cooling a steel strip by blowing inert atmosphere gas on $N_2$ basis upon it wherein the cooling gas contains a large amount of $H_2$ gas that has a great cooling ability, is proposed in Japanese Patent Publication No. Sho 55-1969 and Japanese Patent Laid-Open Publication No. Hei 6-346156, for example.

Although the above-cited Publications suggest the concentration of $H_2$ gas being adjusted within the range of 8–90%, the following problems have not yet been resolved satisfactorily.

(1) While an increase in the concentration of $H_2$ gas surely increases the cooling ability, such an increase of the $H_2$ gas concentration pushes up the running cost.

(2) If the concentration of $H_2$ gas is lowered and the blowoff speed of the gas from nozzles is raised, a higher cooling ability can be achieved. However, if the blowoff speed exceeds a certain value, the running steel strip tends to flutter and suffer from scratches on the surface thereof.

(3) Also, if the cooling gas containing $H_2$ gas is recirculated and only the loss is supplied, the cooling gas can be used efficiently. In this case, however, since the cooling gas is heated by the steel strip to be cooled and consequently becomes a high temperature gas, the cooling efficiency of cooling gas is lowered. In this manner, the appropriate temperature of the cooling gas has not been taken into consideration in the prior art.

The present invention has been made in view of these drawbacks of the conventional method, and its object is to provide a primary cooling method in continuously annealing steel strip more efficiently and in a more inexpensive manner, wherein the concentration of $H_2$ gas, the temperature of cooling gas and the blowing speed of the cooling gas are appropriately selected on the basis of the results of various experiments.

DISCLOSURE OF INVENTION

To achieve the above object, according to the present invention, there is provided a primary cooling method in continuously annealing steel strip comprising a heating step, a soaking step, a primary cooling step including a rapid cooling step at least in a second half thereof, an averaging step, and a final cooling step, which is characterized in that inert atmosphere gas containing $H_2$ gas in the concentration of 30–60% is employed as cooling gas for use in the rapid cooling step, the blowoff temperature of the cooling gas is 30°–150° C., and the blowoff speed of the cooling gas is 100–150 m/sec.

Here, the term "blowoff speed" means the speed at which the cooling gas blown upon the steel strip is ejected from nozzles.

In the above primary cooling step, preferably, the start temperature of the rapid cooling step is 600°–700° C., the end temperature of the rapid cooling step is 200°–450° C., and the relationship between the cooling rate CR (°C./sec) in the rapid cooling step and the strip thickness t (mm) is determined to meet the following formula(1):

$$CR \cdot t \geqq 60^\circ \text{ C. mm/sec} \quad (1)$$

In the above primary cooling step, further preferably, the cooling gas is blown by employing a plurality of nozzles each having a circular hollow cross section and projecting toward the steel strip, and a distance between tip ends of the nozzles and the steel strip is determined to be not greater than 70 mm. In the above primary cooling step, still further preferably, a gas sealing is effected between a zone for rapid cooling step and adjacent zones, and a protection system against explosion is provided in the zone for rapid cooling step.

BEST MODE FOR CARRYING OUT THE INVENTION

The present invention will be described in more detail in conjunction with the accompanying drawings.

Figure 1:
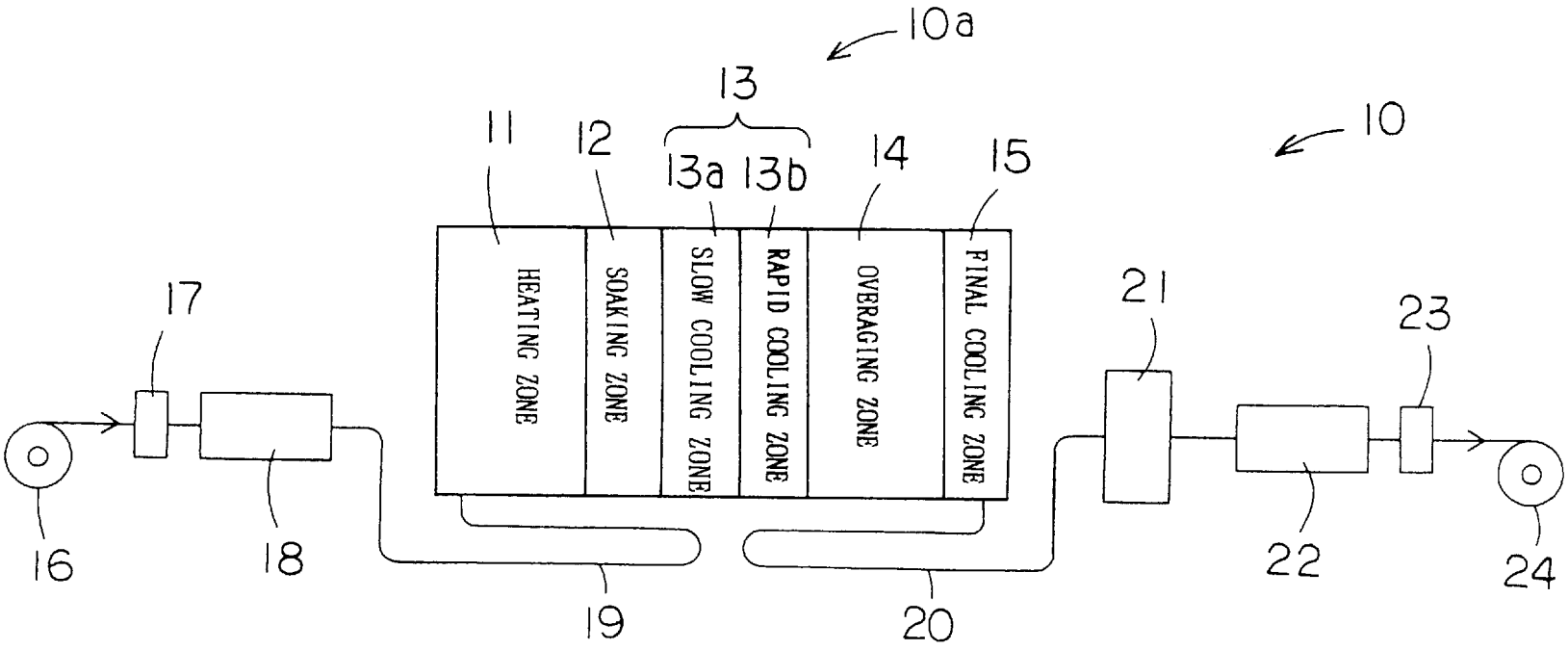
FIG. 1 is an explanatory view of a continuous annealing line for sheet to which is applied a primary cooling method in continuously annealing steel strip according to one embodiment of the present invention.

A furnace section (hereinafter referred to as a continuous annealing furnace) 10*a* of a continuous annealing line 10 to which a primary cooling method in continuously annealing steel strip according to one embodiment of the present invention is applied is shown in FIG. 1. As shown in the drawing, the continuous annealing furnace 10*a* comprises a heating zone 11, a soaking zone 12, a primary cooling zone 13, an overaging zone 14, and a final cooling zone 15 as a secondary cooling zone. The primary cooling zone 13 consists of a slow cooling zone 13*a* in the first half and a rapid cooling zone 13*b* in the second half.

On the entry side of the continuous annealing furnace 10*a*, there are a recoiler 16 for unreeling a material coil, a welder 17 for joining preceding and succeeding steel strips 26 together, a pretreatment apparatus 18 for performing electrolytic cleaning and the like, and an entry looper 19. On the delivery side of the continuous annealing furnace 10*a*, there are a delivery looper 20, a temper rolling mill 21, a finishing apparatus 22 for performing treatment such as side trimming, inspection and oiling of steel strip, a dividing shear 23 for cutting the steel strip 26 in units of product coils, and a coiler 24 for reeling a product coil around the same.

Figure 3:
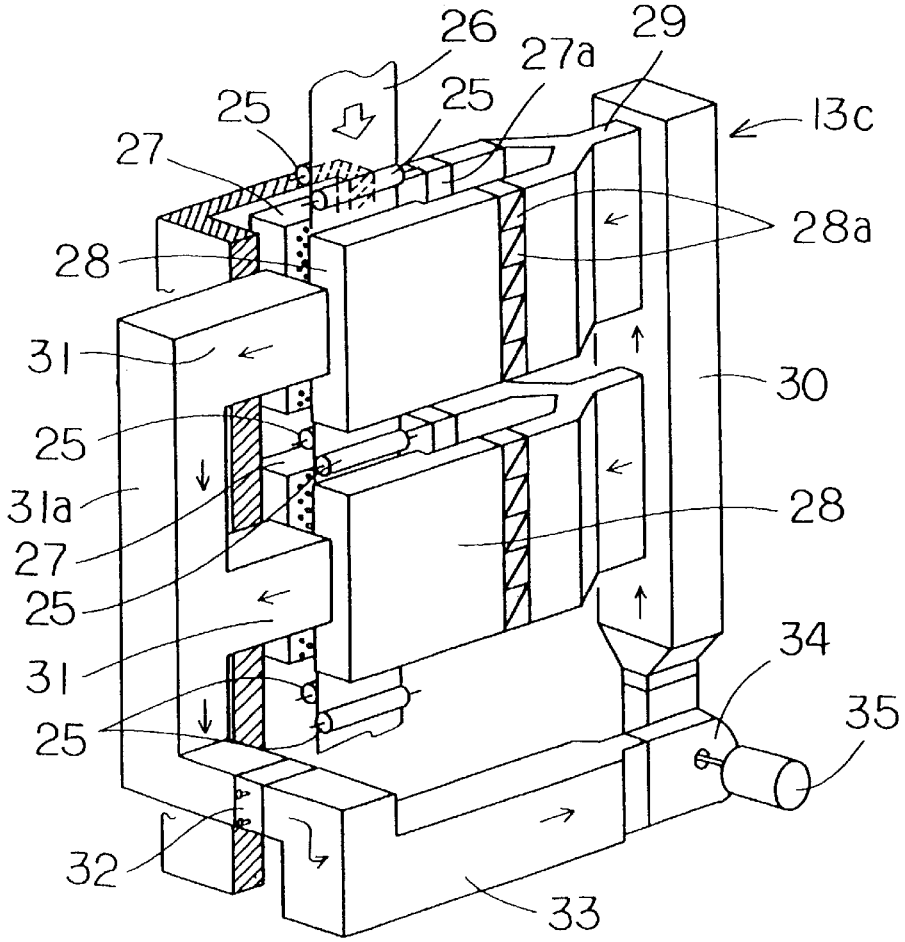
FIG. 3 is a perspective view of an apparatus for carrying out rapid cooling step.

FIG. 3 shows a rapid cooling apparatus 13*c* which constitutes the rapid cooling zone 13*b* in the second half of the primary cooling zone 13. Blow gas boxes 27 and 28 are provided so as to sandwich a steel strip 26 supported by a plurality of stabilizing rolls 25. A unified blow duct 30 for supplying cooling gas is connected to one sides of the blow gas boxes 27 and 28 located at one side of the steel strip 26 through branched blow ducts 29 being Y-shaped in cross-section and then a plurality of dampers 27*a* and 28*a* in parallel.

Suction ducts 31 for collecting the cooling gas blown upon the steel strip 26 are provided at the other side of the steel strip 26. These ducts 31 for collecting the cooling gas are connected to the upper portion of the unified suction duct 31*a* which is provided with a heat exchanger 32 at the lower portion thereof which uses water or the like as a coolant. The heated cooling gas is cooled by the heat exchanger 32 and introduced to a blower 34 through a lower duct 33. Note that in addition to the heat exchanger 32, a refrigerator using fluorocarbon, ammonia or the like as a coolant may also be provided to further cool the cooling gas having been cooled by the heat exchanger 32. In FIG. 3, numeral 35 denotes a driving motor for the blower 34 and each arrow in the drawing indicates a flow direction of the cooling gas.

Figure 4:
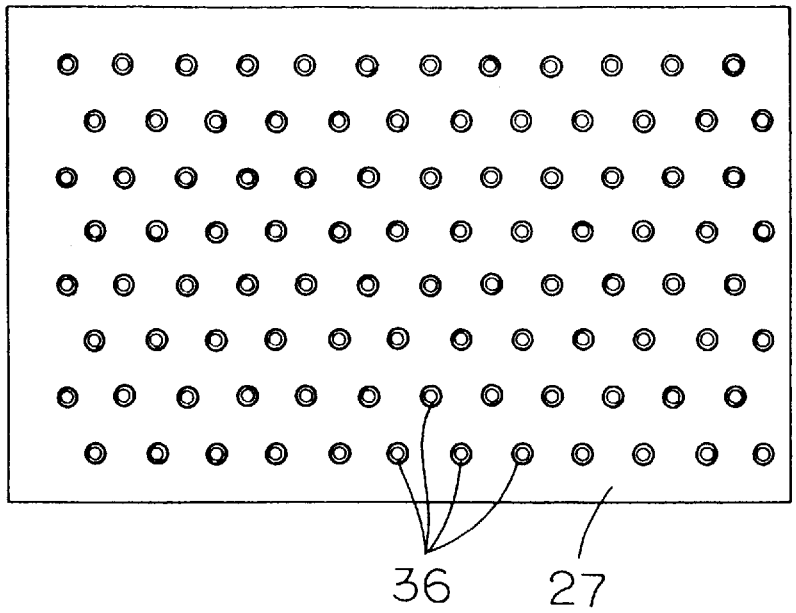
FIG. 4 is a front view of a blow gas box and nozzles thereon for ejecting cooling gas.
Figure 5:
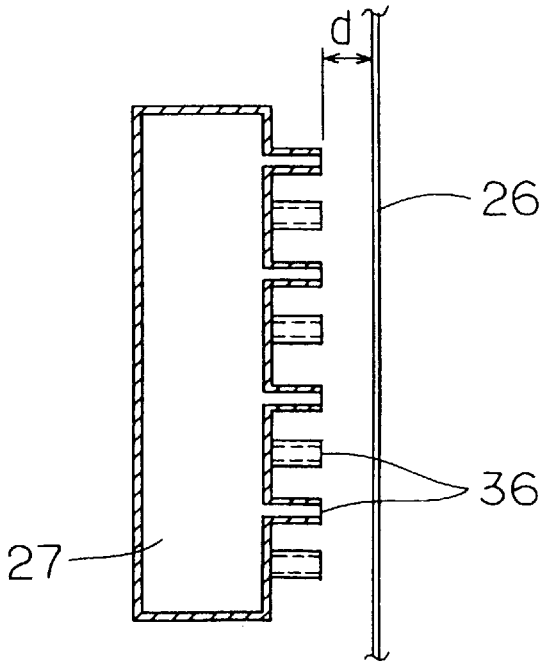
FIG. 5 is a sectional view of the blow gas box and nozzles.
Figure 6:
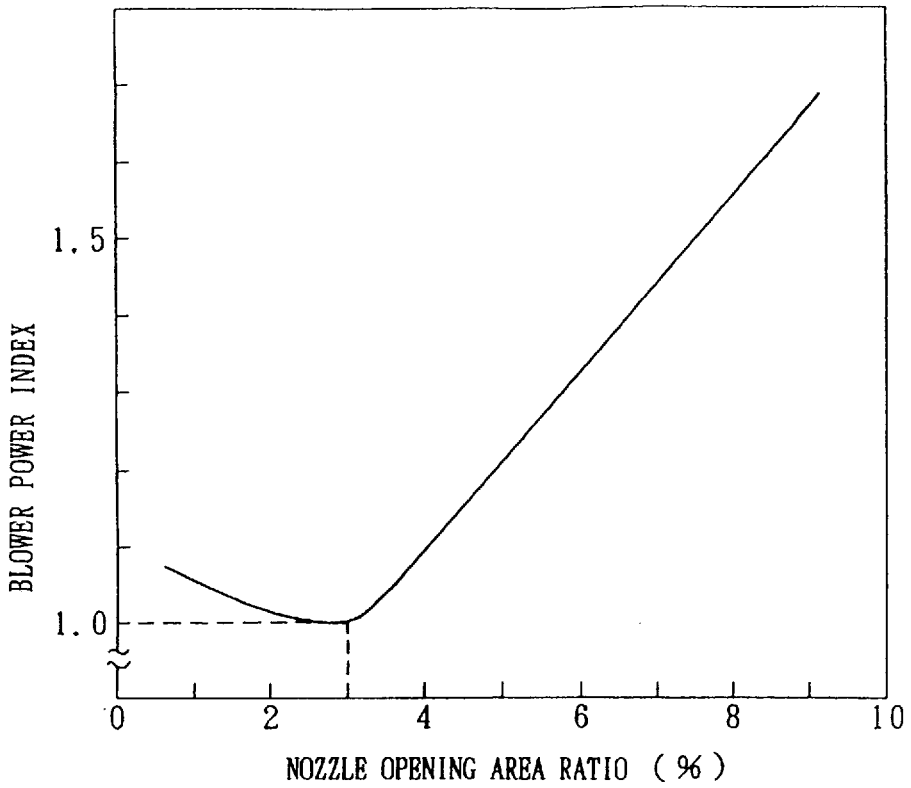
FIG. 6 is a graph showing the relationship between the nozzle opening area ratio and the blower power index.

The blow gas box 27 (or 28) is shown in FIGS. 4 and 5. A multiplicity of nozzles 36 each being formed of a short tube are provided on the front surface of the blow gas box 27. Each nozzles 36 is made of a cylindrical tube having a circular hollow cross section and projects toward the steel strip 26. The inner diameter of the blowoff opening of the nozzle 36 is, for example, 9.2 mm. These nozzles 36 are arrayed on the front surface of the blow gas box 27 in a zigzag pattern. Also, the nozzles 36 are so formed that a total opening area of the nozzles occupies 2 to 4% of the front surface area of the blow gas box 27 and the cooling gas is blown through all the nozzles 36 at a uniform flow rate. FIG. 6 shows the relationship between the nozzle opening area ratio (percentage of opening areas of the nozzles 36 to the front surface area of the blow gas box 27) and the motor power index of the blower 34. As shown in FIG. 6, maximum efficiency results at the nozzle opening area ratio of about 2 to 4%. This result is construed from the reason that so long as the amount of cooling gas blown from the nozzles 36 is the same, if the opening area percentage of the nozzles 36 exceeds 4%, the flow speed of the cooling gas is excessively lowered, while if the opening area percentage of the nozzles 36 does not exceed 2%, the flow speed is excessively increased, thus producing a large pressure loss at the nozzles 36.

Further, the distance from the tip ends of the nozzles 36 to the surface of the steel strip 26, namely, the blowoff distance d as shown in FIG. 5, is determined to be not greater than 70 mm, and the projecting length of each nozzle 36 is set to be not less than (100 mm−d). The reason is that if the distance d from the nozzles 36 to the steel strip 26 is increased, the flow speed of the cooling gas blown upon the surface of the steel strip is much attenuated. The reason of setting the projecting length of each nozzle 36 to be not less than (100 mm−d) is to define an escape space of the cooling gas among the projecting nozzles 36 thereby not only to improve cooling efficiency by preventing the cooling gas having been blown upon and heated by the steel strip from residing on the surface of the steel strip and disturbing the cooling performance, but also to improve cooling uniformity in the direction of width of the steel strip.

Figure 7:
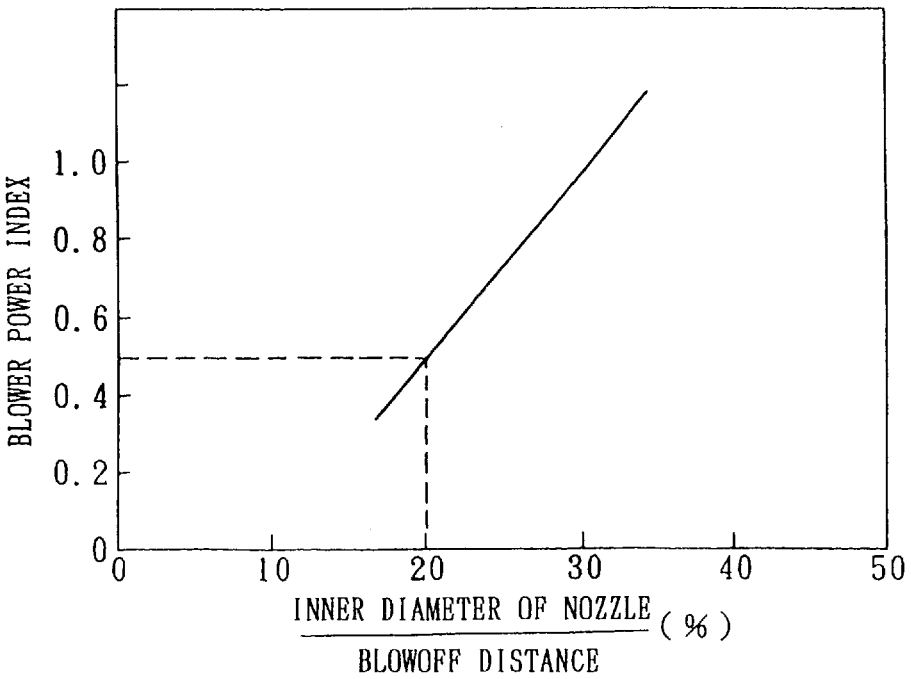
FIG. 7 is a graph showing the relationship between the quotient of inner diameter of nozzle aperture to blowoff distance and the blower power index.

The inner diameter of the blowoff opening will now be considered. FIG. 7 shows the relationship between the quotient of inner diameter of nozzle aperture to the blowoff distance d and the power index of the blower 34. As seen in the drawing, the power of the blower 34 is reduced as the quotient of inner diameter of nozzle aperture to blowoff distance decreases. Also, in order to realize a high cooling ability by blowing the cooling gas through the nozzles 36, it is required to arrange the nozzles 36 at high density such that those portions of individual jet streams of the cooling gas which are located near the nozzle axes and have a maximum cooling ability are densely and uniformly distributed over the steel strip 26. Accordingly, the inner diameter of the nozzle aperture should be as small as possible. However, an excessive reducing of the inner diameter of the nozzle aperture would lead to a disadvantage that the number of nozzles is to be increased and the cost of the facility and maintenance is pushed up. Taking into account these contradictory aspects, the inner diameter of the nozzle opening is preferably set to be not larger than one fifth of the distance d, but not less than 3 mm at which the blowoff opening can be machined practically.

Figure 8:
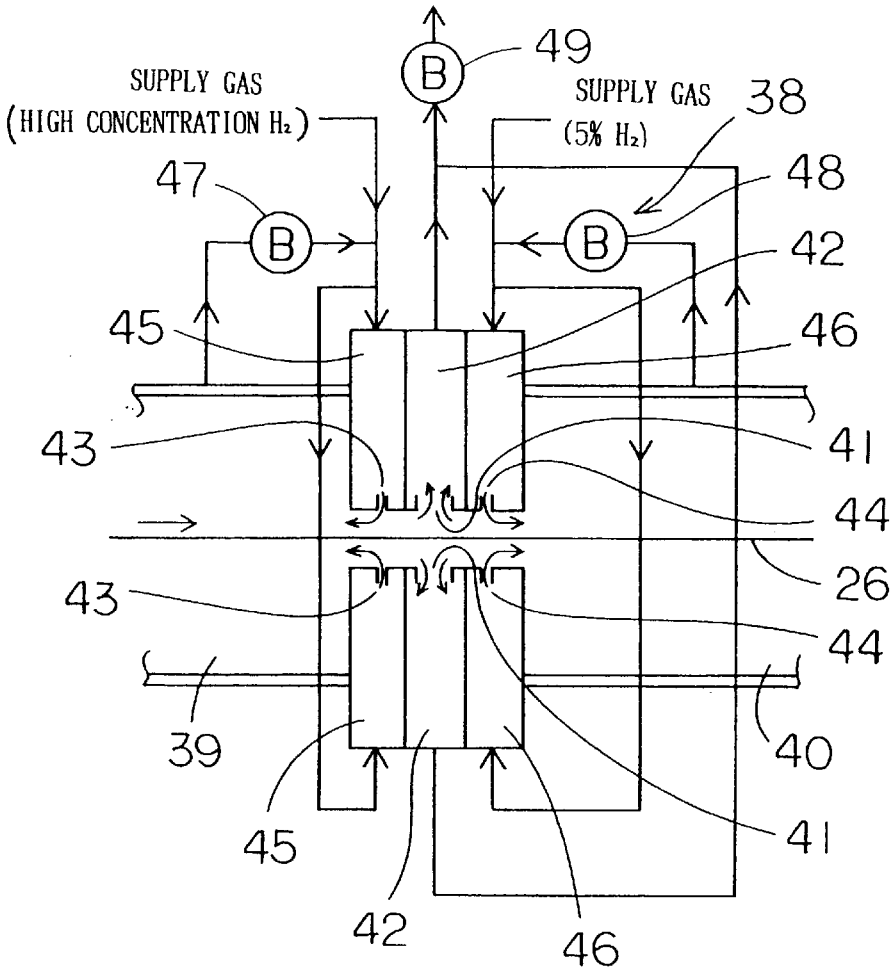
FIG. 8 is an explanatory view of a gas sealing apparatus.

If any different kind of gas is mixed into the rapid cooling zone 13*b* either from the slow cooling zone 13*a* or from the averaging zone 14 which is disposed adjacent to the rapid cooling zone 13*b*, this would give rise to a problem of reducing the $H_2$ concentration in the cooling gas in the rapid cooling zone 13*b* and hence lowering the cooling ability thereof. Also, because inert atmosphere gas which contains $H_2$ gas in a high concentration is employed as the cooling gas in the rapid cooling zone 13*b*, the rapid cooling zone 13*b* must be equipped with an anti-explosion system. Therefore, a gas sealing apparatus 38 as shown in FIG. 8 is provided on each of the upstream and downstream sides of the rapid cooling zone 13*b* in the second half of the primary cooling zone 13 in the continuous annealing line 10. While the gas sealing apparatus 38 interposed between the rapid cooling zone 13*b* and the averaging zone 14 will be described below, the gas sealing apparatus 38 interposed between the slow cooling zone 13*a* and the rapid cooling zone 13*b* also has the same structure.

Between an exit 39 of the rapid cooling zone 13*b* and an entrance 40 of the overaging zone 14, the gas sealing apparatus 38 is provided. The gas sealing apparatus 38 comprises gas suction chambers 42 disposed above and below the running steel strip 26 and having slit-like suction openings 41 which face the top and bottom surfaces of the steel strip 26, and pairs of atmosphere gas blow chambers 45 and 46 disposed at both sides of the upper and lower gas suction chambers 42 and having slit-like blowoff openings 43 and 44 which also face the corresponding surfaces of the steel strip 26.

The cooling gas in the rapid cooling zone 13*b* is supplied through a circulation blower 47 to the upper and lower gas blow chambers 45 on the entry side of the steel strip 26, and is then blown upon both the top and bottom surfaces of the steel strip 26 to form a stream of the gas flowing from the blowoff openings 43 toward the rapid cooling zone 13*b*, thereby preventing the gas from coming out of the rapid cooling zone 13*b* and entering the gas sealing apparatus 38. Likewise, the atmosphere gas in the overaging zone 14 is supplied through a circulation blower 48 to the upper and lower gas blow chambers 46 on the delivery side of the steel strip 26 to form a stream of the gas flowing from the blowoff openings 44 toward the overaging zone 14, thereby preventing the gas from coming out of the overaging zone 14 and entering the gas sealing apparatus 38.

A part of the cooling gas ejected from the blowoff openings 43 flows in the feed direction of the steel strip 26, and a part of the atmosphere gas ejected from the blowoff openings 44 flows in a direction opposite to the feed direction of the steel strip 26. However, since the gas suction chambers 42 are disposed between the gas blow chambers 45 and 46, those parts of the cooling gas and the atmosphere gas are sucked through the suction openings 41 and discharged to the exterior by an exhaust blower 49. Corresponding to shortage of the gases in the rapid cooling zone 13*b* and the overaging zone 14 resulting from being discharged with the operation of the exhaust blower 49, the cooling gas and the atmosphere gas prepared in advance are supplied to the respective zones.

It is therefore possible to prevent the cooling gas containing high concentration $H_2$ gas from the rapid cooling zone 13*b* from entering the averaging zone 14, thereby achieving positive gas sealing, to keep the component concentrations of the cooling gas constant, and to avoid leakage of high concentration $H_2$ gas to save the consumption of the expensive gas and ensure safety in the operation.

A description will now be made of the outline of the operation of the continuous annealing line 10 referring to FIGS. 1 and 2, focusing on the primary cooling method in continuously annealing steel strip according to one embodiment of the present invention.

The steel strip 26 unreeled from the recoiler 16 is joined to another preceding steel strip by the welder 17, and then sent to the pretreatment apparatus 18 including an electrolytic cleaner and the like. After that, the steel strip 26 is supplied through the entry looper 19 to the heating zone 11 of the continuous annealing furnace 10*a* where it is heated above the recrystallization temperature (heating step A). Subsequently, the steel strip 26 is supplied to the soaking zone 12 where it is kept at the temperature of 700°–850° C. for a certain period of time (soaking step B). During these steps A and B, the steel strip 26 is recrystallized and the grain growth proceeds, whereby it is softened and exhibits high workability. However, because carbides in the steel strip 26 are dissolved in the matrix when the steel strip 26 is subjected to thermal treatment at a high temperature, a large amount of carbon in solid-solution state would exist in the steel strip 26 if the steel strip 26 is cooled directly after the soaking step. The presence of carbon in solid-solution state is not desirable for the reason that such carbon is precipitated with time to make the steel strip 26 harder and cause a large yield point elongation.

To reduce the amount of solid-solution state carbon in the steel strip 26 as far as possible, therefore, the steel strip 26 is subjected to averaging treatment in the averaging zone 14 after the soaking treatment. In the overaging zone 14, the steel strip 26 is left to stand for a certain period of time in a certain temperature range (approximately 400° C.) so as to allow the solid-solution state carbon to be diffused. As a result, the solid-solution state carbon is precipitated as cementite ($Fe_3C$) and the amount of solid-solution state carbon in the steel strip 26 is reduced greatly (overaging step D).

To promote the overaging treatment, after the soaking step, the steel strip 26 is first slowly cooled in the slow cooling zone 13*a* down to a certain temperature $T_S$ not higher than the $A_1$ transformation temperature (723° C.), and is then rapidly cooled down to the overaging temperature in the rapid cooling zone 13*b*. This rapid cooling brings about a supersaturated condition in which, at the end point of the rapid cooling (temperature $T_E$ in FIG. 2), the solid-solution state carbon exists in the ferrite matrix in an amount exceeding the limit solubility of carbon allowable at the same temperature in the Fe—C equilibrium diagram. This supersaturated condition promotes precipitation of solid-solution state carbon into cementite during the overaging treatment.

After the soaking step, as mentioned above, the steel strip 26 is slowly cooled in the first half of the primary cooling down to a certain temperature $T_S$ not higher than the $A_1$ transformation temperature. The purpose of this slow cooling is to increase the amount of solid-solution state carbon in the ferrite matrix and to prevent deterioration of flatness of the steel strip such as cooling buckle for achieving satisfactory operation. For those reasons from operational point of view, the upper limit of $T_S$ is 700° C.

Figure 2:
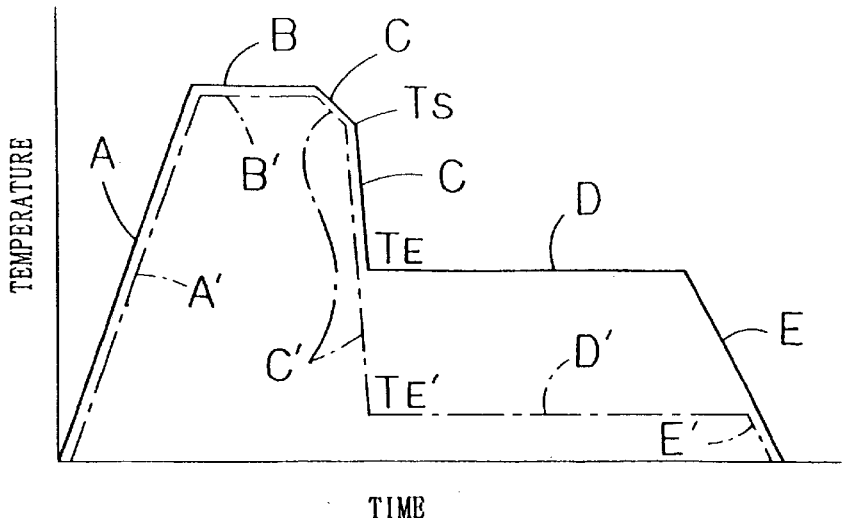
FIG. 2 is a graph showing the relationship between the passing time and the temperature of a steel strip in the furnace section of continuous annealing line.

Also, as seen in FIG. 2, since $T_S$ is the temperature to start the rapid cooling and would be of no significance if it is too close to the overaging temperature at which the rapid cooling is ended, the lower limit of $T_S$ is 600° C.

Further, the upper limit of the rapid cooling end temperature $T_E$ is equal to the upper limit of the averaging start temperature and hence should be 450° C. A cooling rate of the rapid cooling step carried out in the second half of the primary cooling, namely, in the rapid cooling zone 13*b*, is required to be not lower than 60° C./sec, preferably not lower than about 80° C./sec from a metallurgical point of view for achieving the aforesaid supersaturated condition. In other words, if the cooling rate is lower than 60° C./sec, the amount of solid-solution state carbon in the steel sheet as a product would be too large and the product would be excessively hardened, thus deteriorating the workability during press forming (primary cooling step C).

Then, the steel strip 26 after the averaging treatment is slowly cooled down to the room temperature in the final cooling zone 15 (final cooling step E).

When producing a high strength steel strip, particularly a high strength steel strip of dual phase type in which martensite is mixed in the ferrite matrix, an annealing cycle is modified such that the steel strip 26 is heated to a temperature not lower than the $A_1$ transformation temperature (heating step A') and the heated steel strip 26 is kept at the same temperature in the soaking zone 12 to create a two-phase state of ferrite and austenite (soaking step B'), and is then slowly cooled in the slow cooling zone 13*a* before it is rapidly cooled down from the rapid cooling start temperature $T_S$ in the rapid cooling zone 13*b*. Also, the rapid cooling end temperature $T_E'$ is a temperature lower than the martensitic transformation temperature $M_S$ (about 250° C. though depending on chemical composition) so that austenite is efficiently transformed into martensite. Accordingly, a lower limit temperature of $T_E'$ is 200° C. If the cooling rate in the rapid cooling step is not sufficient, the cooling curve would be caught by the noses in the continuous cooling transformation diagram at which transformation into ferrite, pearlite, etc. begins and then a part of austenite would be transformed into such phases, resulting in poor efficiency of the martensitic transformation. From the above reason, the cooling rate of 60° C./sec is required in the rapid cooling step from a metallurcal point of view. In the case of attempting to further save the alloying components, it is desired that the cooling rate be not less than 100° C./sec. This case is represented by one-dot-chain lines in FIG. 2. Specifically, the steel strip is rapidly cooled down to about 200° C. in a primary cooling step C', then it is subjected to a low-temperature holding step D' in the overaging zone 14, and thereafter transferred to a final cooling step E'.

Accordingly, given the cooling rate being CR and the thickness of the steel strip 26 being t, a cooling ability of the rapid cooling zone 13*b* in the continuous annealing furnace 10*a* is required to meet the above-mentioned formula (1), considering that the steel strip 26 annealed in the continuous annealing furnace 10*a* usually has a thickness of about 1 mm.

On the other hand, it is known on the basis of heat transfer theory that the heat transfer coefficient α (kcal/m$^2$h°C.) is expressed by the following formula (2).

$$CR=k\cdot\alpha/t \tag{2}$$

where k is a constant.

This formula (2) can be modified into the following formula (3).

$$CR\cdot t=k\cdot\alpha \tag{3}$$

Putting the formula (3) in the above formula (1) leads to the following formula (4).

$$k\cdot\alpha\geqq 60^\circ\text{ C. mm/sec} \tag{4}$$

Here, when the rapid cooling zone 13*b* is specified as the rapid cooling apparatus 13*c* as shown in FIG. 3, a value of the constant k is determined. By putting this value in the formula (4), a value of the heat transfer coefficient α, which meets the condition of the formula (1), is given by the following formula (5).

$$\alpha\geqq 410\text{ kcal/m}^2\text{h°C.} \tag{5}$$

If cooling by water-gas mixture is employed in the rapid cooling step as mentioned before, the cooling which meets the formula (5) can be performed. However, since a thin oxide film is formed on the surface of the steel strip 26, steps such as light pickling, rinsing after the pickling, special treatment for improving phosphatability, and final rinsing are required in the post-treatment after the annealing. This leads to a disadvantage of pushing up the facility cost. In view of the above, an attention was focused on a method of rapidly cooling the steel strip 26 by blowing jet streams of inert atmosphere gas upon the steel strip 26. Table 1 lists ratios of cooling ability of various kinds of gas at 100° C. which can be used for the rapid cooling provided that the cooling ability of a gas mixture of 95% nitrogen ($N_2$) gas and 5% hydrogen ($H_2$) gas is determined to be 1. According to Table 1, a higher cooling ability can be obtained by using cooling gas that contains a higher concentration of $H_2$ gas. This is attributable to such a difference in value of the physical property that the thermal conductivity of $H_2$ gas is about seven times that of $N_2$ gas.

TABLE 1

| Kind of Gas (100° C.) | Ratio of Cooling Ability |
|---|---|
| 95% $N_2$ gas + 5% $H_2$ gas | 1 (reference) |
| 100% He gas | 1.522 |
| 100% $H_2$ gas | 1.725 |
| 100% Ar gas | 0.666 |

In Japanese Patent Publication No. Hei 2-16375, the applicant of the present invention previously proposed and used the reference gas shown in Table 1 which consists of 5% $H_2$ gas and the rest of $N_2$ gas as the cooling gas wherein the amount of $H_2$ gas is held within the explosion limit. Then, in the actual operation using such a cooling gas consisting of 5% $H_2$ gas and the rest of $N_2$ gas, a high-speed gas cooling process is carried out by raising the blowoff speed of the gas from nozzle openings up to about 100 m/sec so that the cooling ability meeting the formula (6) below is achieved.

$$CR\cdot t=30^\circ\text{ to }50^\circ\text{ C.mm/sec} \tag{6}$$

In the present invention, as explained above, the cooling ability of the rapid cooling zone 13*b* is further increased so as to meet the previously mentioned formula (1), from the demand newly recognized from a metallurgical point of view. Taking into account that the cooling ability of the cooling gas consisting of 5% $H_2$ gas and the rest of $N_2$ gas meets the above formula (6) and the cooling ability of 100% $H_2$ gas is about 1.7 times that of the cooling gas consisting of 5% $H_2$ gas and the rest of $N_2$ gas as shown in Table 1, it is considered that the above formula (5) can be met in theory by using 100% $H_2$ gas as the cooling gas. However, since the cooling gas is discharged in part by the exhaust blower 49 as shown in FIG. 8 and must be continuously supplied, an excessively high concentration of $H_2$ gas would push up the operation cost of the overall facility. Additionally, it is also conceivable to employ He gas as presumed from Table 1, but this method is not practical because He gas itself is too much expensive.

Meanwhile, in accordance with the experimental formula found by the inventors based on pilot line test, the heat transfer coefficient α indicating a degree of cooling ability in the rapid cooling zone 13*b* is a function of the blowoff speed V of the cooling gas from the nozzles and the kind of the cooling gas, and is expressed by the following formula (7).

$$\alpha = K \cdot \lambda^{a} \cdot V^{b} (a>0 \text{ and } b>0) \quad (7)$$

where λ: variable depending on the kind of gas,

V: blowoff speed,

K, a and b: constant.

In the formula (7), the variable λ depending on the kind of gas is increased when the $H_2$ gas concentration increases in the mixture of $N_2$ gas and $H_2$ gas, resulting in larger heat transfer coefficient α, as shown in Table 1. On the other hand, as can be seen from the formula (7), because the heat transfer coefficient α is increased at the higher blowoff speed V of the cooling gas, the cooling ability can be enhanced by increasing the blowoff speed of the cooling gas without using expensive 100% $H_2$ gas as presumed from Table 1. But if the blowoff speed of the cooling gas is increased above a certain value, the cost of electric power necessary for the blower operation is greatly raised and, at the same time, the steel strip 26 is apt to flutter. This tendency becomes more remarkable if the proportion of $N_2$ gas having a larger specific gravity increases. This comes from the fact that the force causing the steel strip to flutter is most affected by or in proportion to kinetic energy of the blow gas, wherein the kinetic energy E of the blow gas is expressed by the following formula.

$$E = \gamma / 2g \cdot v^2 \quad (8)$$

where γ is the specific gravity of the gas, g is the acceleration of gravity, and v is the gas flow speed.

Figure 9:
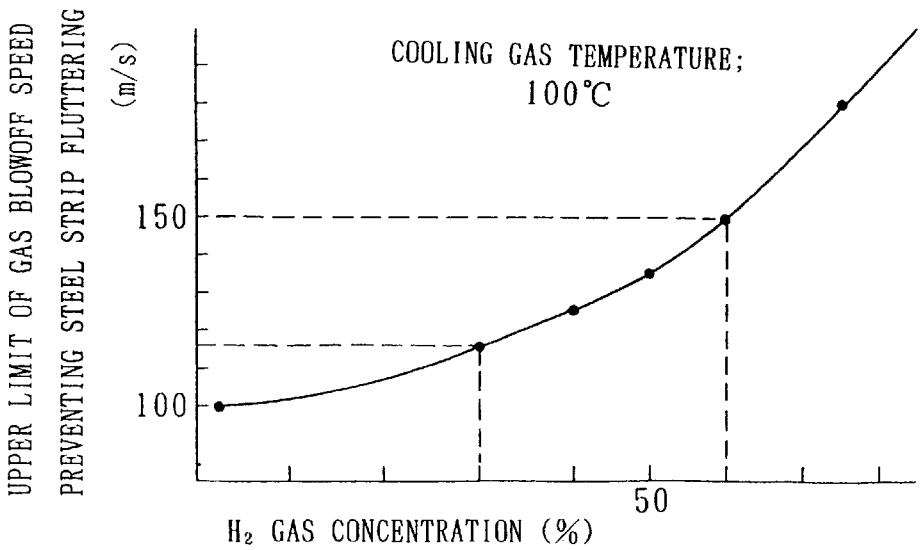
FIG. 9 is a graph showing the relationship between the upper limit of the cooling gas blowoff speed which can prevent the steel strip fluttering and the $H_2$ gas concentration in the cooling gas.

If the steel strip 26 flutters, there arises a problem that the steel strip 26 may hit against, for example, the tip ends of the nozzles 36 and may suffer from scratches. To avoid such a problem, experiments for measuring the gas blowoff speed limit beyond which the steel strip 26 begins to flutter were carried out by using the apparatus as shown in FIG. 3, keeping the temperature of the cooling gas constant (100° C.), and blowing the cooling gas containing various concentrations of $H_2$ gas upon the steel strip 26. The measured results are shown in FIG. 9. The upper limit of gas blowoff speed preventing the steel strip fluttering is somewhat varied depending on the thickness t and tension of the steel strip. Also, by narrowing the spacing between the stabilizing rolls 25 shown in FIG. 3, the tendency of the steel strip fluttering is mitigated and, therefore, the blowoff speed of the cooling gas can be increased correspondingly.

In addition, one factor affecting the condition of the above formula (1) is the temperature of the cooling gas. In the rapid cooling apparatus 13*c* shown in FIG. 3, the cooling gas used for cooling the steel strip 26 is sucked through the suction duct 31 and then subjected to heat exchange in the heat exchanger 32. Since the water which is inexpensive is employed as a coolant for the heat exchanger 32, the temperature of the cooling gas having passed the heat exchanger 32 is in the range of 80°–150° C. From an economical point of view in the field of rapid cooling, however, the temperature of the cooling gas is preferably kept in the range of about 80°–100° C. through more efficient heat exchange. It is further possible to additionally install a refrigerator using fluorocarbon, ammonia or the like as a coolant in association with the heat exchanger 32 so that the temperature of the cooling gas can be kept in the range of 30°–80° C. This enables the steel strip to be cooled more efficiently.

Figure 10:
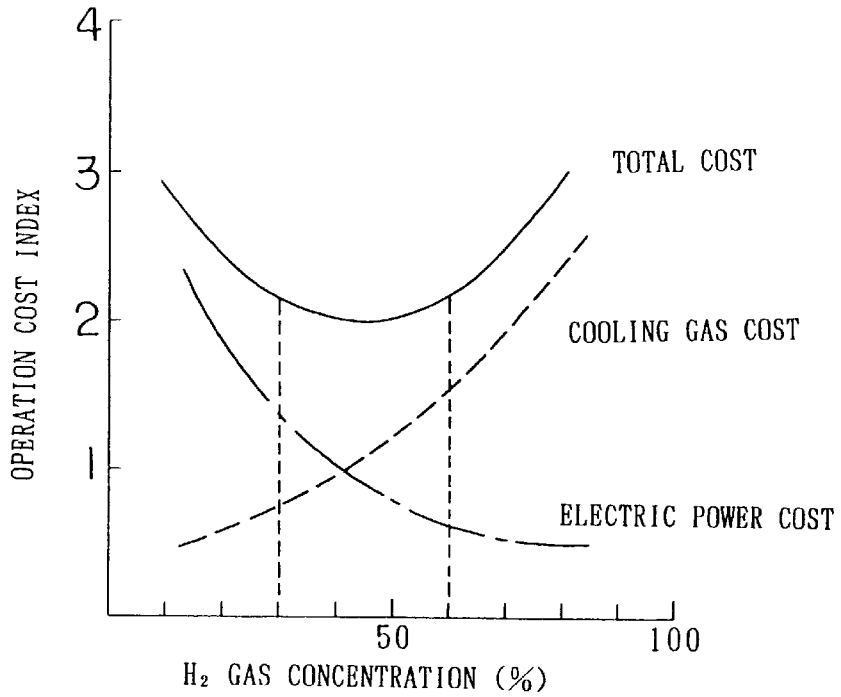
FIG. 10 is a graph showing the relationship between the $H_2$ gas concentration and the operation cost index for the rapid cooling zone.
Figure 11:
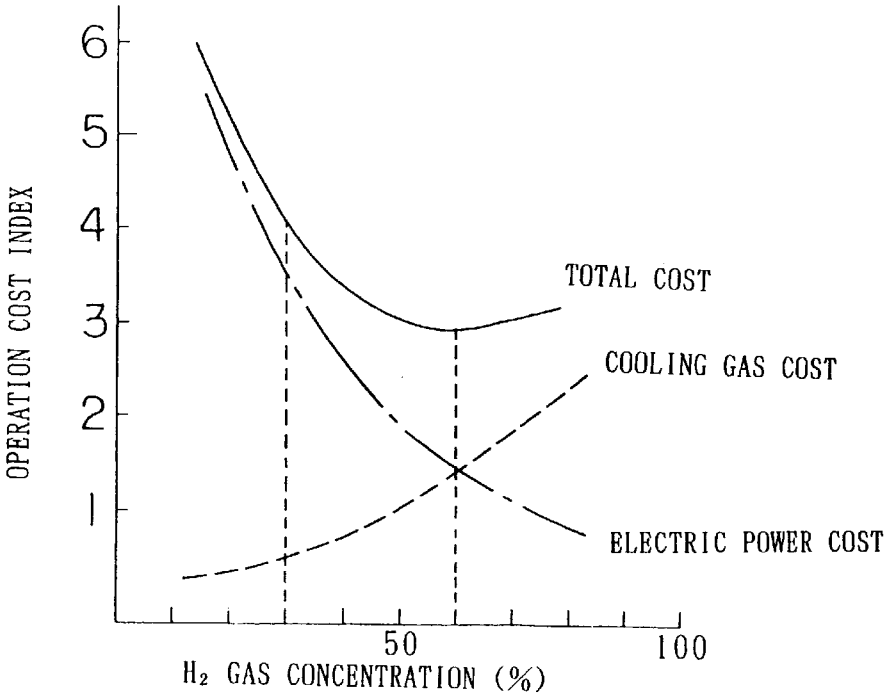
FIG. 11 is another graph showing the relationship between the $H_2$ gas concentration and the operation cost index for the rapid cooling zone.

Further more, if the concentration of $H_2$ gas in the cooling gas is lowered, the concentration of $N_2$ gas is raised and the cost of the cooling gas used is reduced correspondingly because $N_2$ gas is inexpensive. On the other hand, however, if the concentration of $H_2$ gas in the cooling gas is lowered, the concentration of $N_2$ gas is raised and the specific gravity of the cooling gas is increased to push up the cost of electric power consumed by the operation of the blowers and the like. Also, as inferred from Table 1, if the concentration of $H_2$ gas in the cooling gas is raised, the heat transfer coefficient is increased. FIGS. 10 and 11 show respectively results of Experiment 1 and Experiment 2 carried out for studying the operation cost for the rapid cooling zone while varying the concentration of $H_2$ gas in the cooling gas under the conditions meeting the above formula (1). Although the heat transfer coefficient is reduced as the amount of $H_2$ gas in the cooling gas diminishes, such a reduction is compensated for by increasing the blowoff speed of the cooling gas from the nozzles as shown in Table 2 below.

TABLE 2

| Experiment 1 | | Experiment 2 | |
|---|---|---|---|
| $H_2$ gas concentration | Gas blowoff speed | $H_2$ gas concentration | Gas blowoff speed |
| 15% | 133 m/sec | 15% | 156 m/sec |
| 25% | 125 m/sec | 25% | 146 m/sec |
| 50% | 106 m/sec | 50% | 123 m/sec |
| 75% | 100 m/sec | 75% | 116 m/sec |

FIG. 10 shows the operation cost for the rapid cooling zone 13*b* per ton of steel strip resulting on condition that a steel strip being 0.798 mm thick and 1300 mm wide is processed at 270 m/min and the temperature of the steel strip is rapidly cooled down from 675° C. to 410° C.

FIG. 11 shows the operation cost for the rapid cooling zone 13*b* per ton of steel strip resulting on condition that a steel strip being 0.633 mm thick and 1300 mm wide is processed at 260 m/min and the temperature of the steel strip is rapidly cooled down from 670° C. to 270° C. In FIGS. 10 and 11, a broken line represents the cost of the cooling gas, a one-dot-chain line represents the cost of electric power, and a solid line represents the total cost.

The operation cost is minimized at the concentration of $H_2$ gas in the cooling gas being about 45% in the case of FIG. 10, and at about 55% in the case of FIG. 11.

As can be seen in FIGS. 10 and 11, the total operation cost for the rapid cooling zone including the cooling gas cost and the electric power cost is at the lowest level, when the concentration of $H_2$ gas in the cooling gas is in the range of 30–60%.

Figure 12:
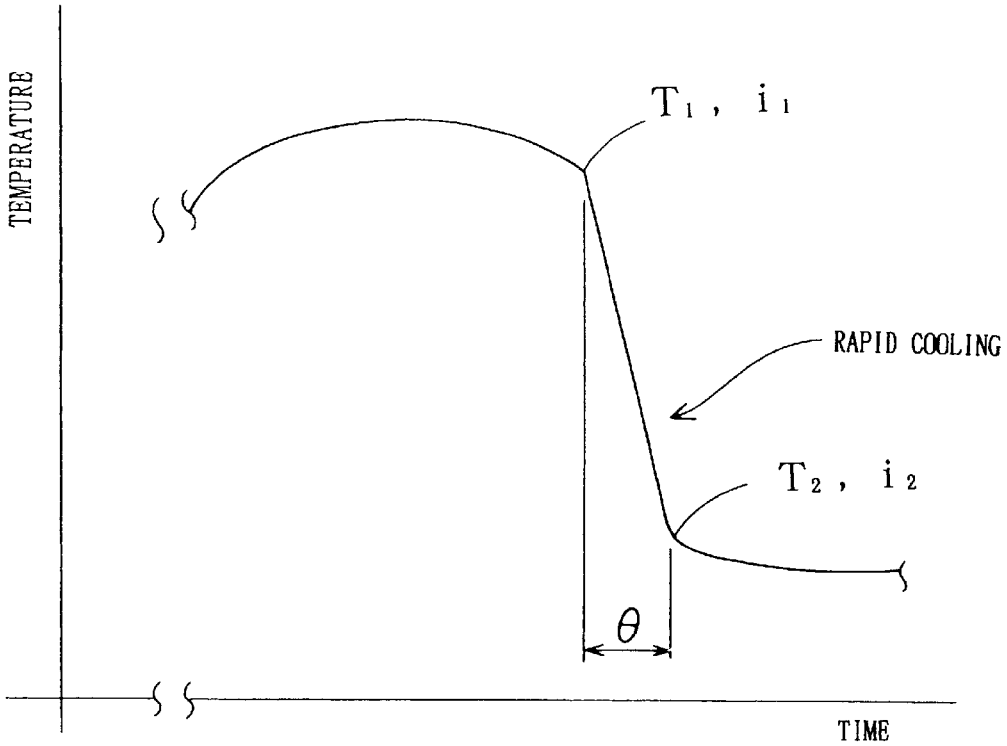
FIG. 12 is a graph showing the relationship between the passing time and the temperature of the steel strip in a rapid cooling zone.

Further more, the heat transfer coefficient α, resulting when cooling conditions such as the shape and array of the nozzles and the blowoff speed of the cooling gas are fixed, is calculated on the basis of the formulae (9) and (10) below by using actual data obtained from the operational experiment for rapid cooling performed as shown in FIG. 12.

$$\alpha = A \cdot t \cdot (i_1 - i_2) / (\Delta T \cdot \theta) \quad (9)$$

$$\Delta T = (T_1 - T_2) / ln(T_1 - Tg) / (T_2 - Tg) \quad (10)$$

where $T_1$: temperature of steel strip on the entry side, $T_2$: temperature of steel strip on the delivery side, $i_1$: enthalpy of steel strip on the entry side, $i_2$: enthalpy of steel strip on the delivery side, θ: passing time of steel strip from the entry side to the delivery side of rapid cooling zone, A: constant, t: thickness of steel strip, and Tg: temperature of cooling gas.

Figure 13:
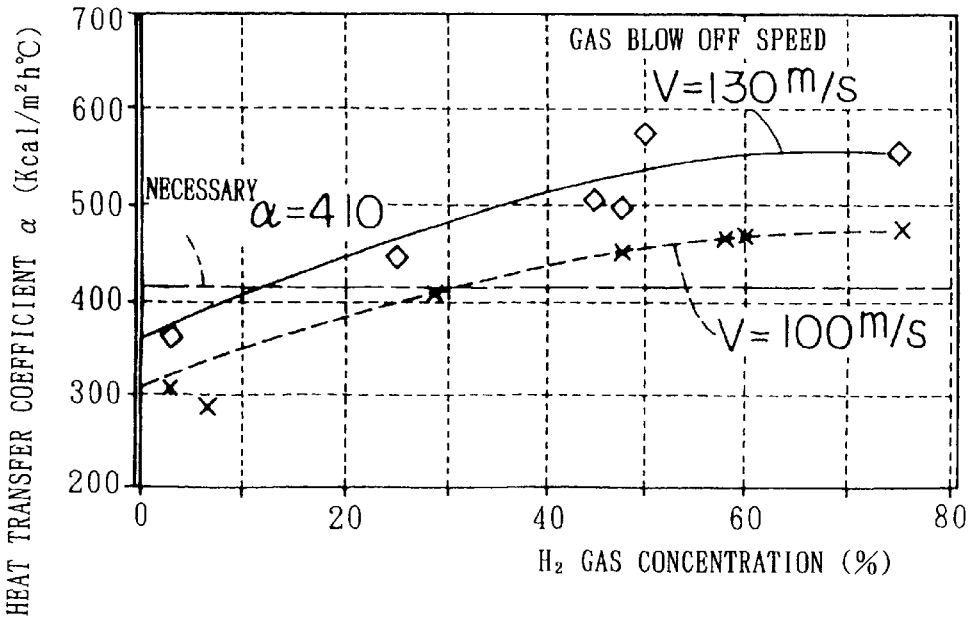
FIG. 13 is a graph showing the relationship between the $H_2$ gas concentration and the heat transfer coefficient.

FIG. 13 shows the heat transfer coefficient α calculated from the data obtained by variously changing the concentration of $H_2$ gas with the blowoff speed of the cooling gas 130 m/sec and 100 m/sec in the experiment shown in FIG. 12. As can be seen from FIG. 13, when the concentration of $H_2$ gas exceeds 60%, the heat transfer coefficient α is saturated. Accordingly, a significant improvement in the cooling effect is not achieved even with the use of cooling gas having a concentration of $H_2$ gas in excess of 60%.

Further, by applying the condition of the above formula (5), which was derived from the metallurgical requirements, to FIG. 13, it is found that the blowoff speed of the cooling gas should,be not less than 100 m/sec and the concentration of $H_2$ gas in the cooling gas should be not lower than 30% to satisfy the above formula (5).

From the results shown in FIGS. 9 to 13, it is understood that the cooling ability capable of satisfying the condition of the above formula (1) is economically attained by using the cooling gas containing $H_2$ gas in the concentration of 30–60%. In this range of $H_2$ gas concentration, the maximum blowoff speed of the cooling gas under which the steel strip does not flutter is 115–150 m/sec, as shown in FIG. 9. However, a lower limit of the blowoff speed of the cooling gas meeting the above other cooling conditions as well as the above formula (5) is 100 m/sec. If the blowoff speed of the cooling gas is less than 100 m/sec, the cooling ability capable of meeting the above formula (5) could not be achieved. This can be construed as follows. In the prior art described in the above-cited Japanese Patent Publication No. Hei 2-16375, on the condition that the concentration of $H_2$ gas is 5% and the cooling gas speed is 100 m/sec, CR·t is in the range of 30°–50° C. mm/sec. It is understood that if the concentration of $H_2$ gas is increased to the range of about 30–60% under the same condition, the cooling ability is enhanced so that CR·t can exceed 60° C.mm/sec. This interpretation will also be apparent from FIG. 13. According to experimental results, when the blowoff speed of the cooling gas is less than 100 m/sec, an immobile layer (sometimes called a boundary layer) adhering to the surface of the steel strip 26 in an immobile state tends to be formed and the heat transfer coefficient is reduced correspondingly.

While the foregoing embodiment has been described in conjunction with specific numerical values for easier understanding of the present invention, the invention can be of course modified within the range not departing from the scope of the invention and any those modifications are also involved in the invention.

INDUSTRIAL APPLICABILITY

With the primary cooling method in continuously annealing steel strip according to the present invention, optimum cooling conditions satisfactory from the viewpoints of both cooling ability and economy can be achieved by properly selecting the $H_2$ concentration, temperature and blowoff speed of the cooling gas.

Further, by setting the rapid cooling start temperature in the primary cooling as 600°–700° C., the rapid cooling end temperature as 200°–450° C., and the product of cooling rate and thickness of steel strip (CR·t) as not less than 60° C. mm/sec, metallurgical requirements on the steel strip processing can be satisfied so as to effect more efficient overaging treatment for mild steel sheets and more efficient transformation process for high strength steel sheets.

Also, by employing the nozzles having circular hollow cross section and projecting toward the steel strip to blow the cooling gas upon the steel strip, and setting the distance between the tip ends of the circular hole nozzles and the steel strip to be not greater than 70 mm, the cooling gas blown from the nozzles at a high flow speed hits against the steel strip efficiently, whereby the steel strip can be cooled with high efficiency without forming any immobile layer on the surface of the steel strip.

In addition, the consumption of expensive $H_2$ gas is greatly saved by effecting the gas sealing between the rapid cooling zone and the adjacent zones. As an anti-explosion system is established, $H_2$ gas in the concentration of 30–60%, which exceeds the explosion limit of $H_2$ gas, can be used as the cooling gas in safety, as mentioned above.

We claim:

1. A primary cooling method in continuously annealing steel strip comprising a heating step, a soaking step, a primary cooling step including a rapid cooling step at least in a second half thereof, an overaging step, and a final cooling step, being characterized in that inert atmosphere gas containing $H_2$ gas in the concentration of 30–60% is employed as cooling gas for use in said rapid cooling step, the blowoff temperature of said cooling gas is 30°–150° C., and the blowoff speed of said cooling gas is 100–150 m/sec.

2. A primary cooling method in continuously annealing steel strip according to claim 1, wherein the start temperature of said rapid cooling step is 600°–700° C., the end temperature of said rapid cooling step is 200°–450° C., and the relationship between a cooling rate CR (°C./sec) in said rapid cooling step and a strip thickness t (mm) is determined to meet a following formula:

$$CR \cdot t \geqq 60^\circ \text{ C. mm/sec.}$$

3. A primary cooling method in continuously annealing steel strip according to claim 1, wherein said cooling gas is blown by employing a plurality of nozzles each having a circular hollow cross section and projecting toward said steel strip, and a distance between tip ends of said nozzles and said steel strip is determined to be not greater than 70 mm.

4. A primary cooling method in continuously annealing steel strip according to claim 1, wherein a gas sealing is effected between a zone for rapid cooling step and adjacent zones, and a protection system against explosion is provided.

5. A primary cooling method in continuously annealing steel strip according to claim 2, wherein said cooling gas is blown by employing a plurality of nozzles each having a circular hollow cross section and projecting toward said steel strip, and a distance between tip ends of said nozzles and said steel strip is determined to be not greater than 70 mm.

6. A primary cooling method in continuously annealing steel strip according to claim 2, wherein a gas sealing is effected between a zone for rapid cooling step and adjacent zones, and a protection system against explosion is provided.

7. A primary cooling method in continuously annealing steel strip according to claim 3, wherein a gas sealing is effected between a zone for rapid cooling step and adjacent zones, and a protection system against explosion is provided.

8. A primary cooling method in continuously annealing steel strip according to claim 4, wherein a gas sealing is effected between a zone for rapid cooling step and adjacent zones, and a protection system against explosion is provided.

* * * * *